United States Patent [19]

Izawa

[11] Patent Number: 4,749,308

[45] Date of Patent: Jun. 7, 1988

[54] SELF-PROPELLED UNDERWATER CABLE BURYING MACHINE

[75] Inventor: Toshio Izawa, Tokyo, Japan

[73] Assignee: Kokusai Denshin Denwa Co., Ltd., Tokyo, Japan

[21] Appl. No.: 24,293

[22] Filed: Mar. 10, 1987

[30] Foreign Application Priority Data

Mar. 27, 1986 [JP] Japan ..... 61-67267

[51] Int. Cl.[4] ..... F16L 1/04

[52] U.S. Cl. ..... 405/163; 37/63; 405/159; 405/161

[58] Field of Search ..... 405/158–165; 37/61–63, 75, 78

[56] References Cited

U.S. PATENT DOCUMENTS

| | | | |
|---|---|---|---|
| 2,755,632 | 7/1956 | Hauber et al. | 405/163 |
| 3,857,250 | 12/1974 | DiTella et al. | 405/160 |
| 3,978,679 | 9/1976 | LeComte | 37/63 X |
| 4,537,530 | 8/1985 | Yamamura et al. | 405/161 X |

FOREIGN PATENT DOCUMENTS

| | | | |
|---|---|---|---|
| 8201952 | 12/1983 | Netherlands | 405/163 |

OTHER PUBLICATIONS

Vehicular Mechanical Arm System, Nov. 21, 1960, General Mills Bulletin 6–B130, pp. 14, 16 and 17.

*Primary Examiner*—Dennis L. Taylor
*Attorney, Agent, or Firm*—Jordan and Hamburg

[57] ABSTRACT

A self-propelled underwater bed cable burying machine is disclosed, which comprises a bottom running gear body with a high pressure water generator mounted therein and an arm-shaped water jet trenching unit mounted the base end capable of revolution in a horizontal plane on a front portion of the running gear body and having a multiple joint degree of freedom. The arm-shaped water jet trenching unit includes an elbow arm having at least one portion capable of being bent in a vertical plane. The elbow arm having a U-shaped hand provided at the free end for capturing and holding an underwater cable. The U-shaped hand having finger portions each provided at least one cable sensor and a trenching water jet nozzle communicating with the high pressure water generator.

1 Claim, 11 Drawing Sheets

SELF-PROPELLED UNDERWATER CABLE BURYING MACHINE

FIELD OF THE INVENTION

This invention relates to a machine for a burying underwater cable and a pipe line (hereinafter referred to as a cable or the like) in the bottom of the water.

DESCRIPTION OF THE PRIOR ART

In order to bury a cable or the like laid on the bottom of the water, it is necessary to dig a trench having predetermined depth and width and introduce the cable or the like into the trench. Heretofore, it has been in practice to use a cable burying machine X, which digs a trench by jetting water under high pressure from a plurality of nozzles arranged in a multistage array and leads the cable or the like into the trench and bury it in the groove while running over the bottom of the water. FIGS. 9A to 9C show an example of the water bed cable burying machine X which has been used for burying the cable or the like in the above method. In the Figures, reference numeral 1 designates a bottom running gear body, and numeral 2 a high pressure water generator, numeral 3 a multistage array water jet trenching unit FIG. 9A is a side view, FIG. 9B is a front view, and FIG. 9C is a sectional view taken along line IXC—IXC. As is seen from these Figures, the prior art burying machine X digs a trench in the bottom G of the water with water jetting from nozzles 4 and 4' of a multistage array (two-row six-stage array in this example) water jet trenching unit 3 and advancement of the running gear body 1, while at the same time the cable $\alpha$ or the like to be buried is introduced into a downwardly open guide gutter 6 of trough type with rib pipes 5 and 5' of the multistage array water jet trenching unit 3 as shown in FIG. 9C. In this way, the cable or the like is burried progressively. At this time, a cable searching unit 7 is used for the tracking of the cable $\alpha$ or the like, and also front and rear cable retainers 8 and 9 are used to retain the cable $\alpha$ or the like in the guide gutter 6 of the multistage water jet trenching unit 3.

In order to bury the cable $\alpha$ or the like laid on the bottom G of the water with the burying machine X, the machine X is run with the multistage array water jet trenching unit 3 brought up to a position right under the running gear body 1 with a hydraulic cylinder 10. When the machine X finds the cable $\alpha$ or the like, it has to set the cable $\alpha$ or the like in the guide gutter 6 of the multistage array water jet trenching unit 3 and close the front and rear retainers 8 and 9. The dimensions of the multistage array water jet trenching unit 3 are determined by the burying depth and diameter of the cable $\alpha$ or the like. Usually, the unit 3 is considerably long and comparatively narrow. Therefore, it is necessary to guide the running gear body 1 such that the guide gutter 6 of the multistage array water jet trenching unit 3 is accurately positioned over the cable $\alpha$ or the like that has been laid, pull the cable $\alpha$ or the like into the guide gutter 6 and then close the front and rear cable retainers 8 and 9. It is very difficult to perform such complicated operation under only remote control from the surface, and heretofore assistance of divers has been necessary for the operation. This means that the initial setting operation of the burying machine X can be done only in shallow water areas with water depths of up to about 50 m where divers can perform ordinary bottom operations of the water.

In another aspect, during the burying operation the cable or the like has to be smoothly guided into the downwardly open guide gutter 6 of the multistage array water jet trenching unit 3 which is comparatively long in shape as noted before. Therefore, it is required to lay the cable or the like as straight as possible. Otherwise, a curved cable or the like is liable to be obstructed by the inner wall of the guide gutter and can not be smoothly introduced due to its rigidity. For example, where the digging depth of the trench is 200 cm and the inclination angle of the multistage water jet trenching unit is 40 degrees, the minimum necessary length of the unit is 311 cm. Assuming the inner width of the guide gutter to be 25 cm and the diameter of the cable or the like to be 6 cm, the minimum radius of curvature of laying of a cable or the like, with which the unit can be smoothly passed is, from calculation, 645 cm, and this means that a comparatively large radius of curvature is required. Meanwhile, it is difficult to change the running direction with a small radius of curvature with the long trenching unit plunged into the earth.

Usually, a cable or the like which is laid continuously for a long distance is comparatively straight, so that less problems arise when burying it. However, cables or the like which are laid near a splicing point or re-laid after repair are often curved with small radius of curvature. It is difficult to bury or follow such curved cables, and sometimes it is impossible to bury the cable or the like.

Further, a cable or the like in the neighborhood of the borderline between the cable which has been buried and the cable which has not been buried can not be introduced into the multistage array water jet trenching unit. For these reasons, it is impossible to bury the cable or the like having small lengths in the neighborhood of the start and end points of burying corresponding to the borderline noted above.

SUMMARY OF THE INVENTION

The invention seeks to overcome the drawbacks noted above in the prior art by the provision of a self-propelled underwater cable burying machine, which permits comparatively ready initialization of the underwater cable burying machine without need of assistance of divers, burying of a cable or the like laid in curved fashions and burying of the cable or the like near the start and end points of burying without leaving non-buried portion.

According to the invention, there is provided a self-propelled underwater cable burying machine, which comprises a bottom running gear body with a high pressure water generator mounted therein and an arm-shaped water jet trenching unit mounted the base end capable of revolution in a horizontal plane on a front portion of the running gear body and having a multiple joint degree of freedom, the arm-shaped water jet trenching unit including an elbow arm having at least one portion capable of being bent in a vertical plane, the elbow arm having a U-shaped hand provided at the free end for capturing and holding an underwater cable, the U-shaped hand having finger portions each provided at least one cable sensor and a trenching water jet nozzle communicating with the high pressure water generator. So the arm-shaped water jet trenching unit is like a so-called backhoe arm with the U-shaped hand replaced with a bucket mounted on the end of a hinged boom.

DESCRIPTION OF THE PREFERRED EMBODIMENT

An embodiment of the invention will now be described with reference to the drawings.

Figure 1:
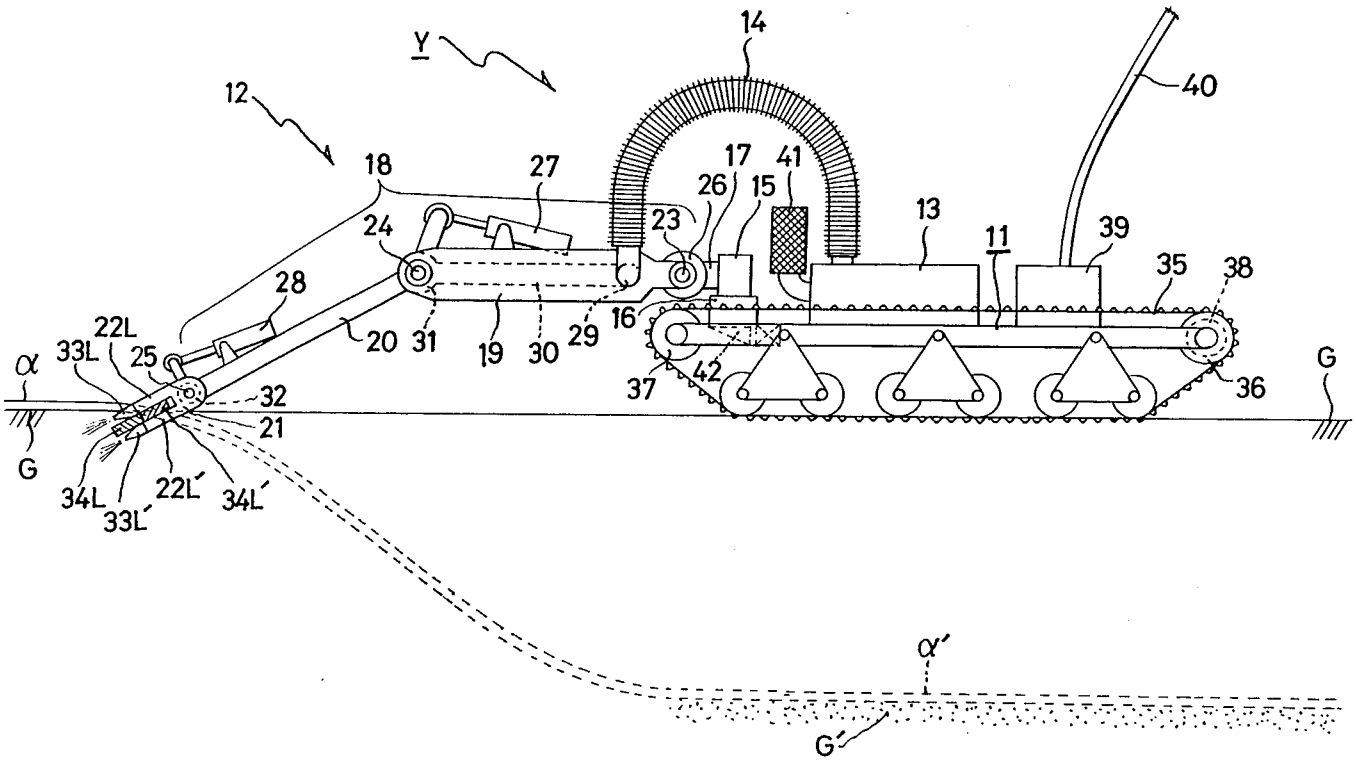
FIGS. 1A and 1B are a side view and a plan view, respectively, showing the basic construction of an embodiment of the self-propelled underwater cable burrying machine.
Figure 1:
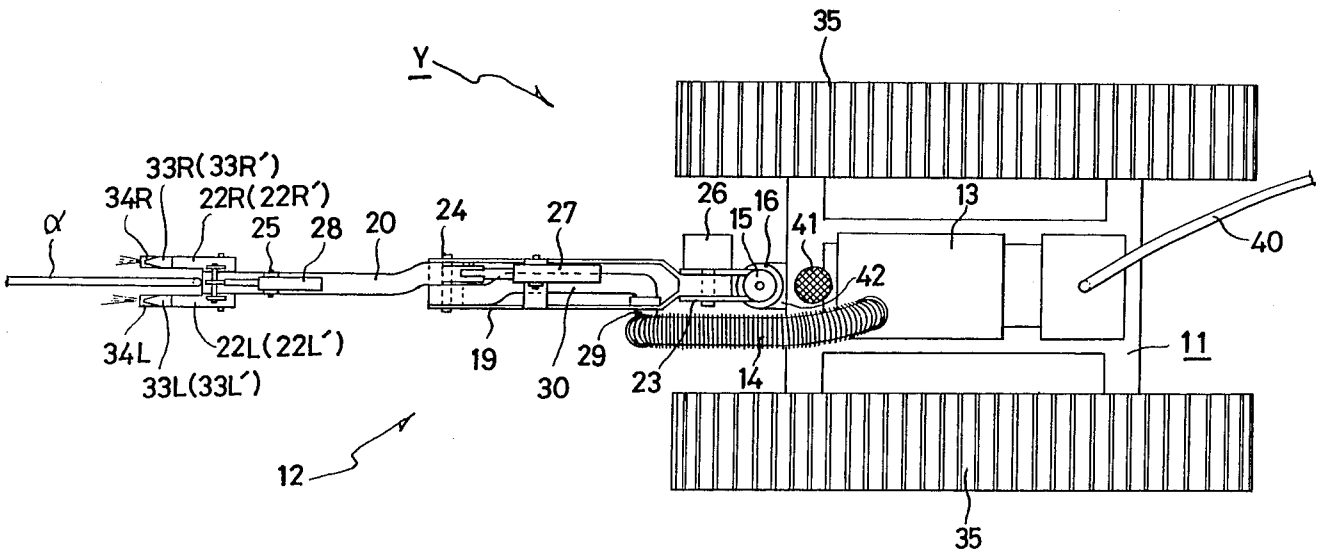

FIG. 1 illustrates the basic construction of the self-propelled underwater cable burying machine Y according to the invention, with FIG. 1A being a side view and FIG. 1B being a plan view.

Referring to the Figure, the machine Y has a running gear body 11. An arm-shaped water jet trenching unit 12 is mounted on a front portion of the running gear body 11 such that it forwardly extends from the body 11. Water under high pressure is supplied from a high pressure water generator 13 to the unit 12 through a hose 14.

The arm-shaped water jet trenching unit 12 has a shoulder arm 17, which can be revolved in a horizontal plane with rotation of a horizontal shoulder joint 15 by a hydraulic motor 16.

The unit 12 also has an elbow arm 18, which includes an upper arm 19, a lower pipe arm 20 and a U-shaped hand 21 having left pipe fingers 22L and 22L' and right pipe fingers 22R and 22R'. The arms 17, 19 and 20 and the U-shaped hand 21 are coupled to one another by first to third vertical joints 23 to 25. The elbow arm 18 can be bent in a vertical plane by the interlocked operation of the hydraulic motor 26 and hydraulic pistons 27 and 28 belonging to the respective joints 23 to 25. Water under high pressure is led from a water supply port 29 provided in a base portion of the upper arm 19 into the upper arm 19 to be led through a water duct line 30 provided in the upper arm 19, a water rotary joint 31 provided in the second vertical joint 24, a lower pipe arm 20 also serving as a water duct, a water rotary joint 32 in the third vertical joint 25 and left and right pipe fingers 22L, 22L', 22R and 22R' of the U-shaped hand 21 also serving the water duct line and jet from left and right nozzles 33L, 33L', 33R and 33R' at the finger tips. A cable searching unit y is constituted by mounting cable sensors 34L, 34L', 34R and 34R' between the pipe fingers 22L and 22L' and pipe fingers 22R and 22R', between the nozzles 33L and 33L' and between the nozzles 33R and 33R'. The unit y performs detecting operations for search, capturing, holding and follow of a cable $\alpha$ or the like to be buried.

Figure 2A:
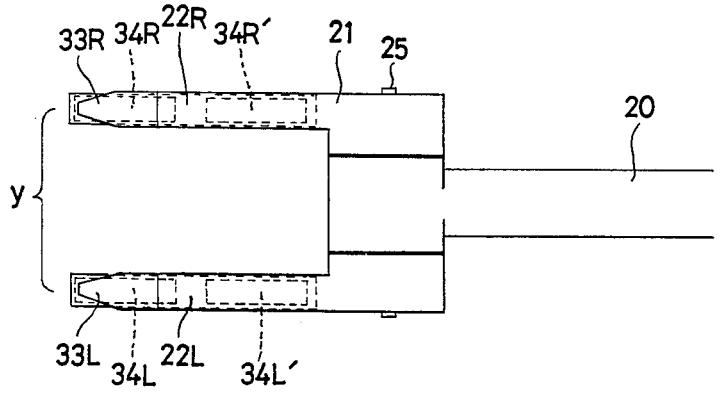
FIGS. 2A and 2B are a plan view and a side view, respectively, showing a cable searching unit.
Figure 2B:
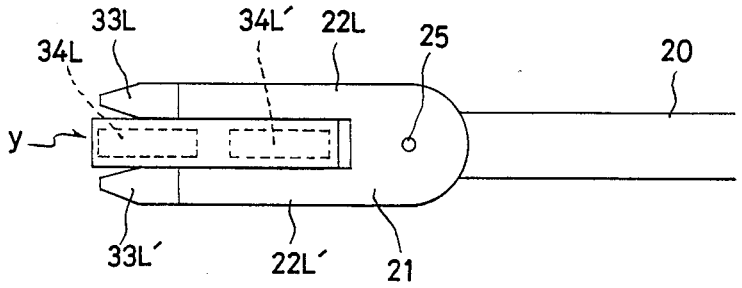

As shown in FIGS. 2A and 2B, the cable searching unit y consists of four cable sensors 34L, 34L', 34R and 34R', which are electromagnetic sensors for detecting an alternating magnetic field radiated from a cable $\alpha$ or the like.

Referring to the Figure, reference numeral 35 designates a caterpillar, numeral 36 a drive sprocket, numeral 37 an idler sprocket, numeral 38 a hydraulic motor, numeral 39 a control unit, numeral 40 an umbilical cable, and numeral 41 a water suction strainer. These components are the same as those in the prior art machine X. Numeral 42 designates a base, on which the hydraulic motor 16 is mounted.

Figure 3:
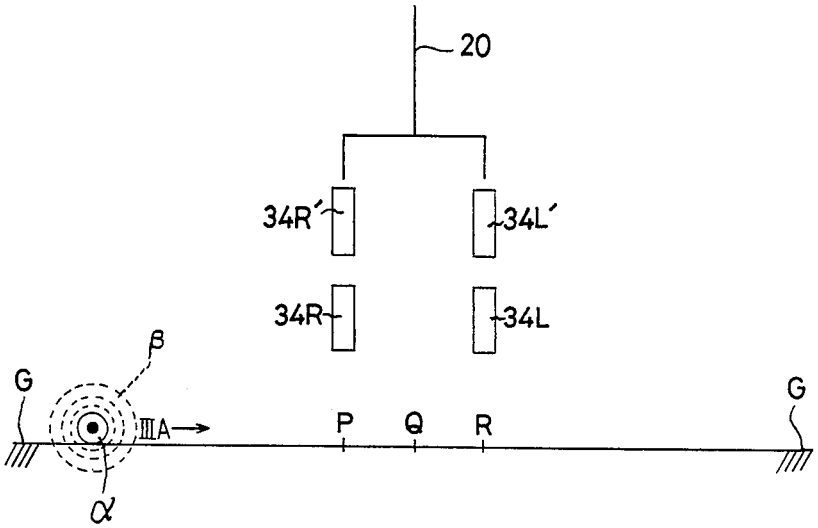
FIGS. 3A, 3B, 4A and 4B are views for explaining the cable searching procedure and sensor output voltage characteristics.
Figure 3:
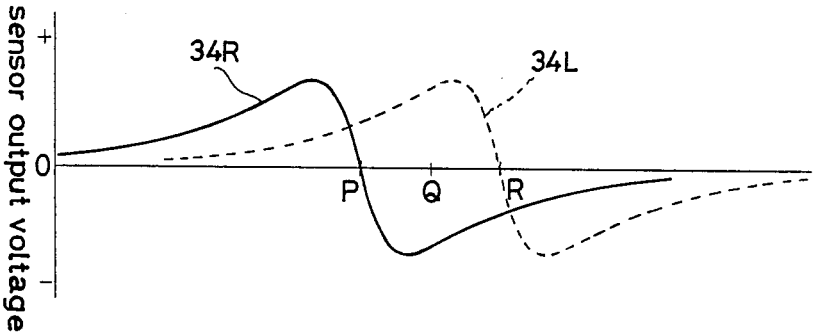
Figure 4A:
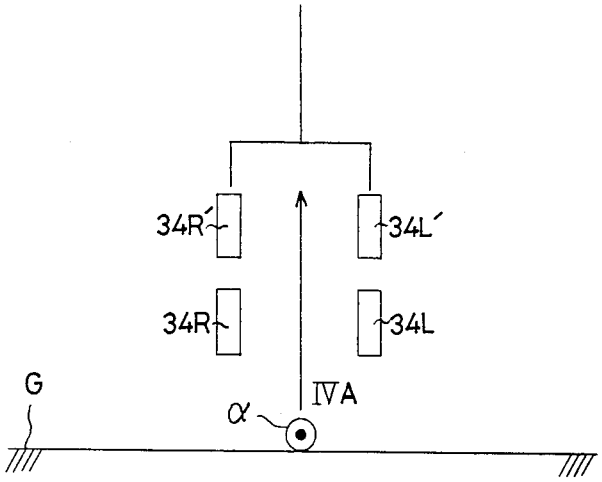
Figure 4B:
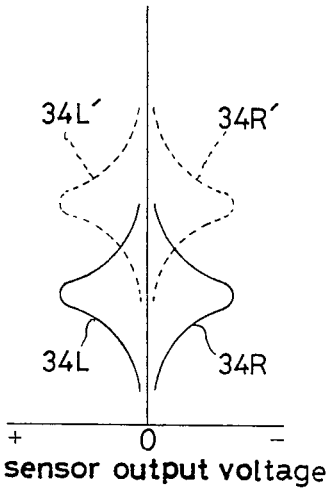

With the above construction according to the invention, the cable $\alpha$ is searched by the cable searching unit y in the manner, which will now be described with reference to FIGS. 3A and 3B, and 4A and 4B. Referring to FIG. 3A, an alternating current is passed through a cable $\alpha$ or the like which is shown normal to the paper so that an AC magnetic field $\beta$ is generated. In this state, by moving the cable $\alpha$ or the like along the bottom G of the water from the left to the right in the Figure as shown by arrow IIIA, the output voltages of the sensors 34R and 34L are changed uniquely when the cable $\alpha$ or the like passes by points P and R right beneath the cable sensors 34R and 34L, as shown in FIG. 3B. The sign (+) and (−) in the ordinate of the Figure representing the output voltage represents a 180-degree phase shift. At mid point Q between the cable sensors 34R and 34L, the output voltages of the cable sensors 34R and 34L are equal and 180-degree out-of-phase with respect to each other. Using the above characteristics and by horizontally moving the cable searching unit y along the bottom G of the water, it is possible to cause the cable $\alpha$ or the like to approach the unit y and capture the cable $\alpha$ or the like at each of the points P, Q and R. When the cable $\alpha$ or the like is captured at the mid point Q between the cable sensors 34R and 34L, the unit y is lowered for the cable $\alpha$ to be led into between the left and right pipe fingers 22L, 22L', and 22R, 22R' of the U-shaped hand 21. FIG. 4A shows a case, in which the cable $\alpha$ or the like is moved upwardly as shown by arrow IVA. In this case, the output voltages of the cable sensors 34R, 34R', 34L and 34L' are changed as shown in FIG. 4B. By using these characteristics, it is possible to detect the position of the cable $\alpha$ or the like between the left and right pipe fingers 22L, 22L' and 22R, 22R' of the U-shaped hand 21. In this way, the operation of the elbow arm 18 of the arm-shaped water jet trenching unit 12 to capture and hold the cable $\alpha$ or the like in the U-shaped hand 21.

Figure 5A:
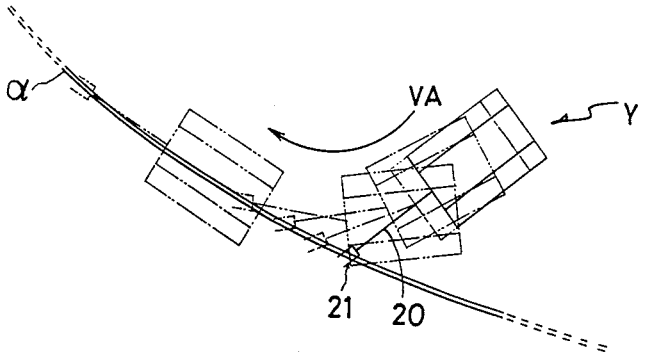
FIGS. 5A to 5C are views for explaining stepwise progress of the initial setting, start of burying and burying operation.
Figure 5B:
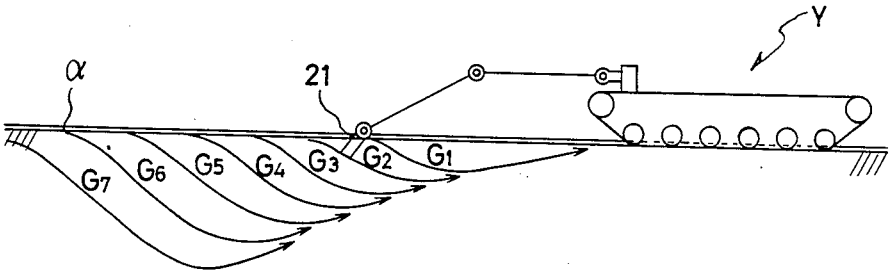
Figure 5C:
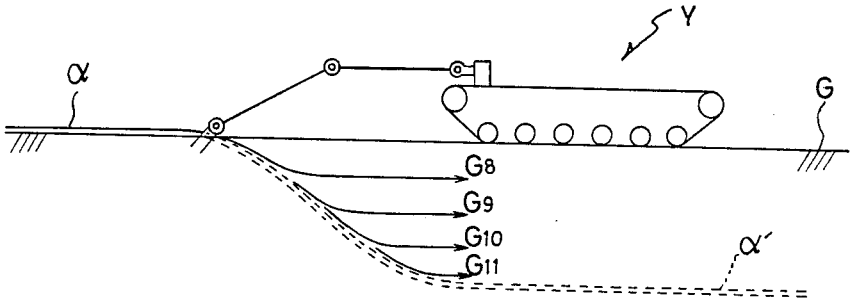

Now, the first access to the laid cable $\alpha$ or the like by the burying machine Y according to the invention, i.e., initial setting, and burying of the cable at the start point of burying, will be described with reference to FIGS. 5A to 5C. Referring to FIG. 5A, the burying machine Y according to the invention runs along the bottom G of the water to approach the cable $\alpha$ or the like which has been laid. Then, the machine Y runs along the direction of arrow VA by following the cable $\alpha$ or the like with the cable searching unit y at the end of the arm-shaped jet trenching unit 12 in the cable searching procedure noted before, so that it eventually strides the cable $\alpha$ or the like. Then, it captures the cable $\alpha$ in the U-shaped hand 21 as shown in FIG. 5B. In this case, the cable α or the like can be very readily captured compared to the case of the prior art trenching machine X because of the operation of the elbow arm 18 of the arm-shaped water jet trenching machine 12 having a comparatively large degree of freedom and the simplicity of operation of capturing the cable α or the like between the left and right pipe fingers 22L, 22L' and 22R, 22R' of the U-shaped hand 21.

FIG. 5B shows a case of starting the burying of the laid cable α or the like from an intermediate point thereof. The digging, i.e., burying, depth is progressively increased as shown by lines G1 to G7 to reach the prescribed depth. FIG. 5C shows a case of making the initial setting at the boundary between the cable α or the like which has not yet been buried and the cable α or the like which has been buried. The digging depth is progressively increased as shown by lines G8 to G11 to reach the prescribed depth.

The manner of burying the cable α or the like with the machine Y will now be described in detail with reference to the schematic views of FIGS. 6A and 6B.

Figure 6A:
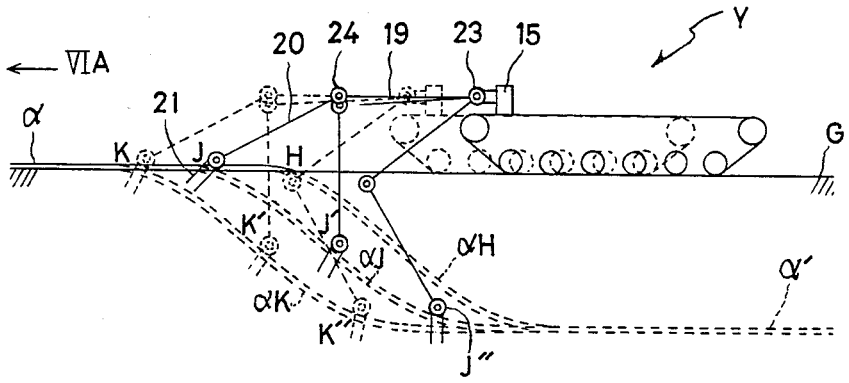
FIGS. 6A and 6B are views for explaining the procesure of burying operation.
Figure 6B:
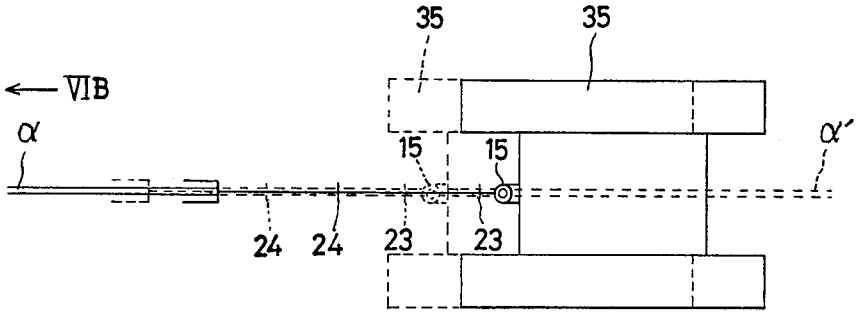

Referring to FIG. 6A, it is assumed that the cable α has been buried from right side of the Figure up to a curve αH. As shown by solid lines, the elbow arm 18 of the arm-shaped water jet trenching unit 12 is extended to bring the U-shaped hand 21 to a point J which is slightly ahead of point H. The cable α or the like is then captured in the U-shaped hand 21. The U-shaped hand 21 is then moved from position J to position J' and thence to position J" while jetting water from the nozzles 33L, 33L', 33R and 33R' at the ends of the pipe fingers 22L, 22L', 22R and 22R' along a curve αJ and also forcing down the cable αH or the like to a position αJ.

When the U-shaped hand 21 has reached the prescribed burying depth point J", it is returned to the initial position J along the curve of the cable αJ or the like while holding the cable αJ or the like such that it will not be detached from the left and right pipe fingers 22L, 22L', 22R and 22R'. Then, the running body 11 is slightly advanced in the directions of arrows VIA and VIB by tracing the cable α or the like with the U-shaped hand 21 to shift the U-shaped hand 21 from the position J to the position K. Then, the U-shaped hand 21 is moved from position K to position K' and thence to position K" to dig the trench while forcing down the capable αJ or the like to the position of curve αK in the manner as described before. When the prescribed burying depth point K" is reached by the U-shaped hand 21, the hand 21 is brought back to the point K along the curve of the cable αK or the like. The above sequence of operations, i.e., digging of the trench, burying of the cable α or the like and running of the running gear body, is repeatedly performed to bury the cable α or the like progressively.

The procedure of operation of burying a cable or the like with the burying machine Y according to the invention is slightly complicated compared to the prior art machine X. However, since the hydrodynamic force given to the water jet is not distributed in a multistage array as in the prior art but is concentrated at the end of the elbow arm 18, the trenching efficiency is increased that much, and sufficient trench digging can be obtained with respect to a hard clayey soil which has heretofore been difficult to dig. Further, the bending and turning actions of the large freedom degree because of the elbow arm of the arm-shaped water jet trenching unit are effective for the initial setting of the burying machine and the burying of a curved cable or the like and the burying of a cable or the like at the start and end points of burying.

Now, a case of burying a cable α or the like which has been laid in a curved shape will be described with reference to FIGS. 7A and 7B.

Figure 7A:
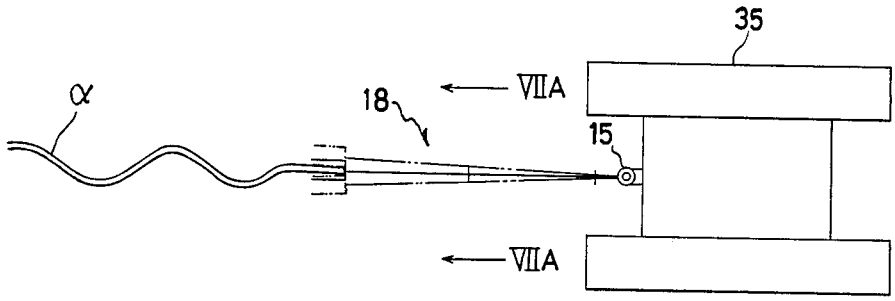
FIGS. 7A and 7B are views for explaining the operation of burying a cable or the like laid in a curved fashion.
Figure 7B:
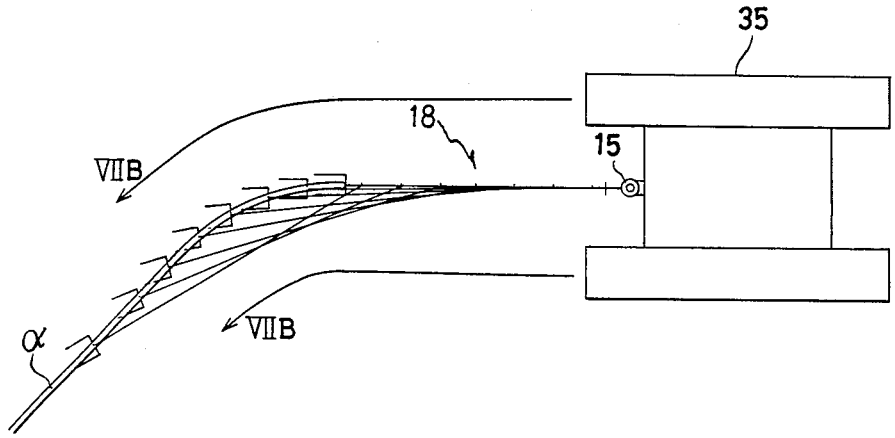

FIG. 7A shows a case, in which the cable α or the like is laid in a finely waving fashion. In this case, the elbow arm 18 of the arm-shaped water jet trenching unit 12 is swung to the left and right after the shape of the laid cable α or the like as shown by dotted lines, thereby digging the trench and burying the cable α or the like. However, the running direction need not be varied finely to the left and right as shown by arrow VIIA. FIG. 7B shows a case, in which the cable α or the like is laid in a largely curved fashion with a small radius of curvature. In this case, the burying is possible by setting a small distance of intermittent advancement of the running gear body in the ordinary digging procedure as well as the swing of the elbow arm 18 of the arm-shaped water jet trenching unit 12 in the direction of the curve of the cable α or the like and change of the running direction as shown by arrow VIIB. The cable α or the like thus can be buried smoothly without the possibilities of obstruction of the cable α or the like by the trenching unit or self-prevention of a large change in the running direction of the burying machine.

Now, the burying at the last point will be described with reference to FIGS. 8A and 8B.

Figure 8A:
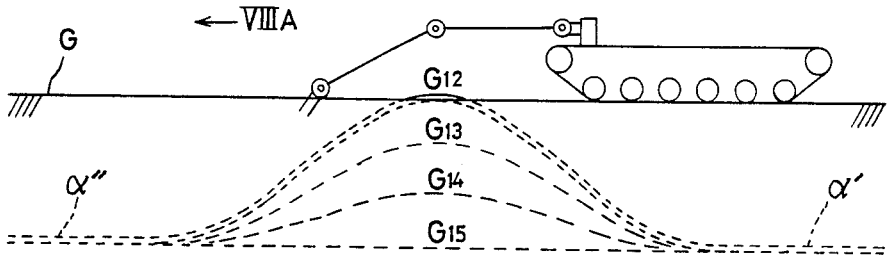
FIGS. 8A and 8B are views for explaining stepwise progress of burying operation at the end point of burying.
Figure 8B:
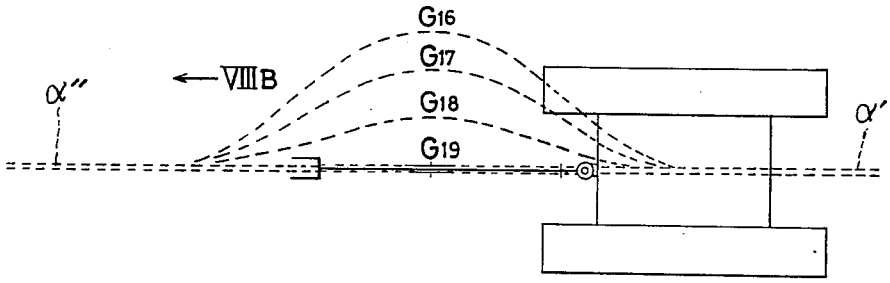
Figure 9A:
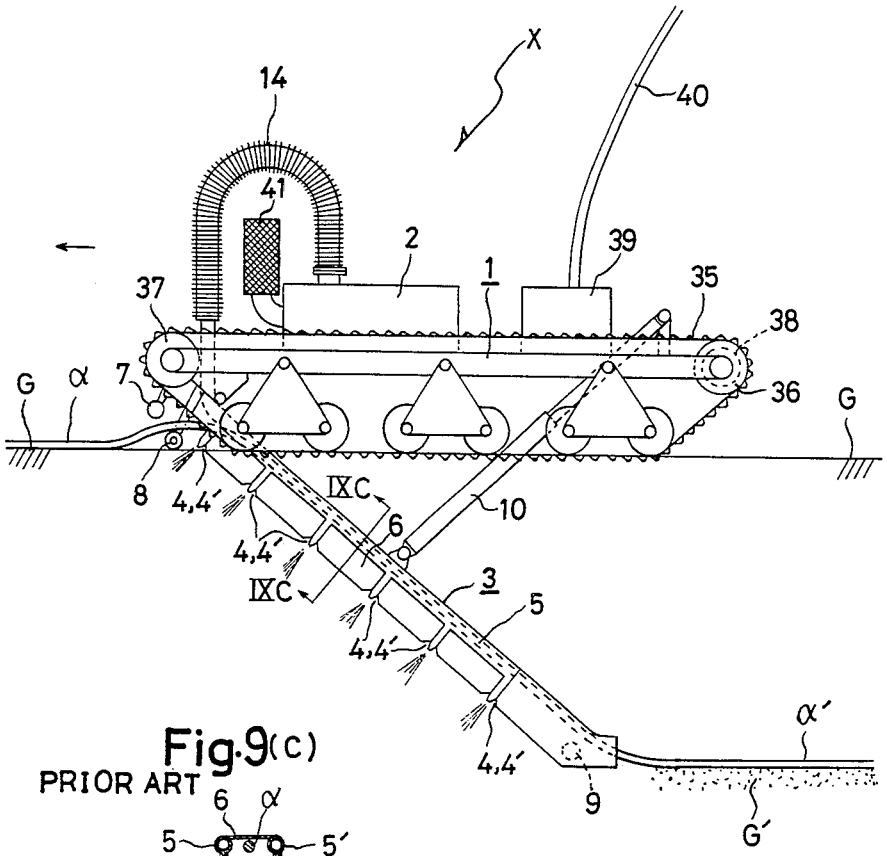
Fig.9(A) PRIOR ART
FIGS. 9A to 9C are a side view, a front view and a sectional view taken along line IXC—IXC in FIG. 9A, respectively, showing the basic construction of a prior art underwater cable burying machine.
Figure 9C:
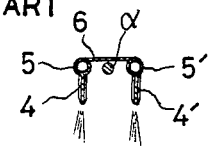
Fig.9(C) PRIOR ART
Figure 9B:
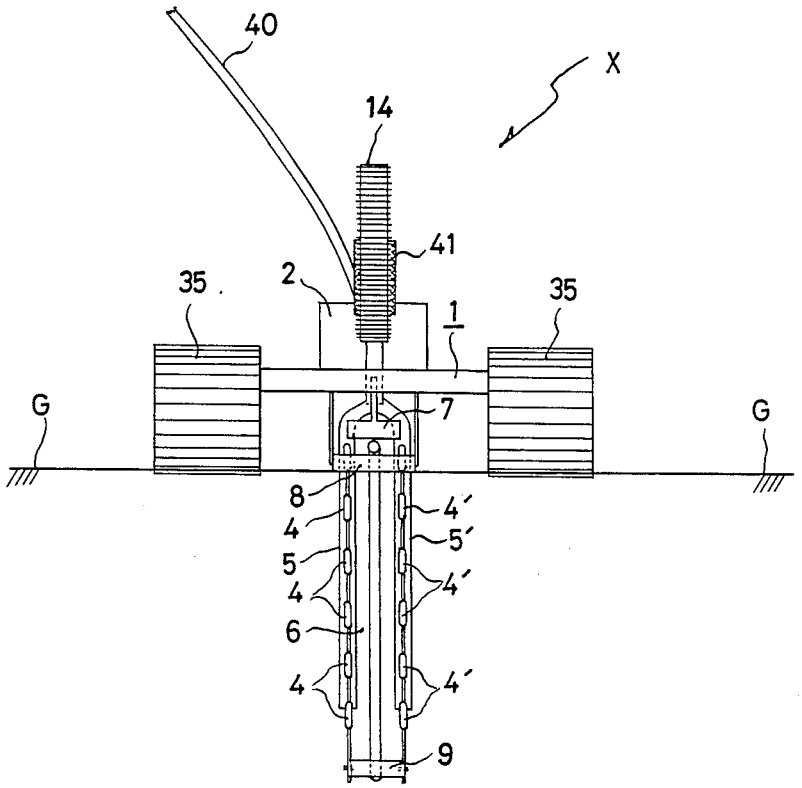
Fig.9(B) PRIOR ART

Referring to FIG. 8A, when the burying machine having been burying the cable α' or the like from the right side of the Figure as shown by arrow VIIIA finally comes to the borderline with the buried cable α", a hill-shaped portion of non-buried cable α is left as shown by line G12. This remaining portion of the cable or the like forced down by the arm-shaped water jet trenching unit 12 as shown by lines G12 to G15. In this case, however, there is a redundant length of cable α or the like. Therefore, the remaining portion of the cable or the like is laid sidewise as shown by lines G19 to G16, and then the machine proceeds in the direction of arrow VIIIB.

As has been described in the foregoing, according to the invention it is possible in the burying of the cable α or the like having been laid to provide extreme improvements over the facts that the place for initial setting the burying machine with respect to a cable or the like has been limited to shallow water areas with depths of up to about 50 m and that it has been difficult to bury a cable or the like laid in a curved fashion with a small radius of curvature and obtain burying of a cable or the like near the start and end points of burying. Thus, it is made possible initialization of the burying machine with respect to a cable or the like which is free from limitation on the water depth, facilitate the burying of a cable or the like laid in a curved fashion with a small radius of curvature and obtain perfect burying of a cable or the like at the start and end points of burying. The invention thus has very great utility, and great effects can be expected when it is utilized for the initial laying and burying of a cable or the like and also for difficult works of re-burying of a repaired and re-laid cable or the like. Further, it is applicable to the searching of the buried cable or the like and digging out.

What is claimed is:

1. A self-propelled underwater cable burying machine comprising a bottom running gear body means with a high pressure water generator means mounted therein and an arm-shaped water jet trenching unit means mounted on the base end capable of revolution in a horizontal plane on a front portion of said running gear body means and having a multiple joint degree of freedom, said arm-shaped water jet trenching unit means including an elbow arm means having at least one portion capable of being bent in a vertical plane, said elbow arm means having a U-shaped hand means provided at the free end for capturing and holding an underwater cable, said U-shaped hand means having finger portions each provided with at least one cable sensor means and a trenching water jet nozzle means communicating with said high pressure water generator means.

* * * * *